US006247782B1

(12) United States Patent
Takata

(10) Patent No.: US 6,247,782 B1
(45) Date of Patent: Jun. 19, 2001

(54) INK JET RECORDING DEVICE CAPABLE OF RELIABLY DISCHARGING AIR BUBBLE DURING PURGING OPERATIONS

(75) Inventor: Masayuki Takata, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/328,461

(22) Filed: Jun. 9, 1999

(30) Foreign Application Priority Data

Jun. 11, 1998 (JP) ..... 10-163053

(51) Int. Cl.[7] ..... B41J 2/165
(52) U.S. Cl. ..... 347/30; 347/92
(58) Field of Search ..... 347/30, 35, 20, 347/92, 65

(56) References Cited

U.S. PATENT DOCUMENTS 5,825,386 * 10/1998 Ohashi ..... 347/71
6,003,968 * 12/1999 Kozawa ..... 347/20
6,003,986 * 12/1999 Keefe ..... 347/92

* cited by examiner

*Primary Examiner*—N. Le
*Assistant Examiner*—Shih-wen Hsieh
(74) *Attorney, Agent, or Firm*—Oliff & Berridge, PLC

(57) ABSTRACT

An ink jet head 31 is formed with two rows of plurality of ejection channels 33 through which ink droplets are ejected. A manifold 40 is formed with an ink supply path 43 which fluidly connects the ejection channels 33 with an ink cartridge 50. The ink supply path 43 includes a small diameter connection path 44 and a broad portion 45. The broad portion 45 broadens in a tapering manner from the connection path 44 side to the ink jet head 31 side. The broad portion 45 is provided with guide walls 45*c* which define narrow ink channels 45*d*. The presence of the guide walls 45*c* decreases the volume of the broad portion 45, thereby increasing ink flow speed during purging operations. The rapid ink flow easily removes air bubbles clinging to an inner surface of the ink supply path 45. In this way, the air bubbles are reliably discharged out of the ink supply path 45 during the purging operations.

14 Claims, 8 Drawing Sheets

INK JET RECORDING DEVICE CAPABLE OF RELIABLY DISCHARGING AIR BUBBLE DURING PURGING OPERATIONS

BACKGROUND OF THE INVENTION

1. Field of the Invention

The present invention relates to an ink jet recording device having a manifold fluidly connecting an ink cartridge with an ink jet head.

2. Description of the Related Art

A conventional ink jet recording device includes an ink jet head having actuators. The actuators are formed from an electromechanical converting element or electrothermal converting element, and define a plurality of ink chambers aligned in a row. An ink cartridge storing ink is detachably attached to the ink jet head by a manifold. The manifold is formed with an ink supply path that normally broadens from the ink cartridge side to the ink jet head side so as to encompass the entire row of ink chambers. Ink in the ink cartridge is supplied through the ink supply path of the manifold into the ink chambers. When the actuators are energized, ink is ejected from the ink chambers through nozzles to form an image on a recording medium.

Normally, ink stored in the ink cartridge has some air dissolved therein. Also, a certain volume of air is introduced into the ink supply path of the manifold when the ink cartridge is exchanged. The air in the ink supply path can grow into a large air bubble, and obstruct supply of ink into the ink chamber. Also, the air can be drawn into the ink chambers along with ink, thereby blocking the ink chambers. This prevents ink from being ejected from the ink chambers, resulting in defective printing.

In order to overcome these problems, purging operations are performed periodically and also directly after the ink cartridge is exchanged. Specifically, a negative purging pressure is applied to the nozzles of the ink jet head. As a result, fresh ink is supplied from the ink cartridge into the ink supply path and the ink chambers. At the same time, air is sucked out of the ink supply path with some ink.

However, when fresh ink is introduced from the ink cartridge, the speed of ink flow greatly reduces at position where the ink supply path broadens. As a result, ink does not easily reach corner portions of the ink supply path, so that the air usually remains at the corner portions. Then, the residual air clings to an inner surface of the ink supply path. When the air floats freely as small air bubbles in the ink supply path, the air bubbles are easily discharged by the purging operations. However, air bubbles that cling to inner surfaces are not sufficiently discharged even during the purging operations. Particularly, the air tends to froth up at locations where the shape of the ink supply path changes. Resultant bubbles cling the side surfaces.

The residual air bubbles which have not been discharged even during purging operations grow into large bubbles, and eventually block the ink chambers. Accordingly, printing will become defective shortly after purging operations. This requires that purging operations be frequently performed during printing. Because purging operations require several minutes to perform, this prevents smooth and quick printing operations.

SUMMARY OF THE INVENTION

It is an objective of the present invention to solve the above-described problems and also to provide an ink jet recording device capable of reliably discharging air out of an ink supply path and introducing fresh ink from an ink cartridge into the ink supply path during purging operations.

In order to achieve the above and other objectives, there is provided an ink jet recording device including an ink jet head and a manifold. The ink jet head has a first surface and a second surface opposite from the first surface, and is formed with at least two channels rows aligned in parallel with each other. Each of the at least two channels rows includes a plurality of channels. Each channel extends from the first surface to the second surface and has an ink inlet port opened at the first surface and an ejection nozzle opened at the second surface. The manifold is formed with an ink supply path fluidly connecting the plurality of channels and a cartridge that stores ink. The ink supply path includes a connection portion and a broad portion. The connection portion is centered between the at least two channel rows and fluidly connected to the cartridge. The broad portion broadens from a connection portion side to a first surface side of the ink jet head so as to encompass the ink inlet ports of the plurality of channels. The manifold includes guide walls positioned between the at least two channel rows.

There is also provided an ink jet recording device including an ink jet head and a manifold. The ink jet head has a first surface and a second surface opposite from the first surface. The ink jet head is formed with a plurality of channels extending from the first surface and the second surface and having an ink let port on the first surface and an ejection nozzle on the second surface. The manifold is formed with an ink supply path fluidly connecting the plurality of channels with a cartridge that stores ink. The ink supply path includes a first portion and a second portion. The first portion is fluidly connected to the cartridge. The second portion is fluidly connected to the first portion and the plurality of channels. The second portion has a width that induces capillary action to draw the ink through the second portion.

BRIEF DESCRIPTION OF THE DRAWINGS

The particular features and advantages of the invention as well as other objects will become more apparent from the following description taken in connection with the accompanying drawings, in which.

DETAILED DESCRIPTION OF THE PREFERRED EMBODIMENT

An ink jet recording device 1 according to a preferred embodiment of the present invention will be described while referring to the accompanying drawings. In the following description, the expressions "upper", "lower", and "horizontal", are used throughout the description to define the various parts when the ink jet recording device is disposed in an orientation in which it is intended to be used.

Figure 1:
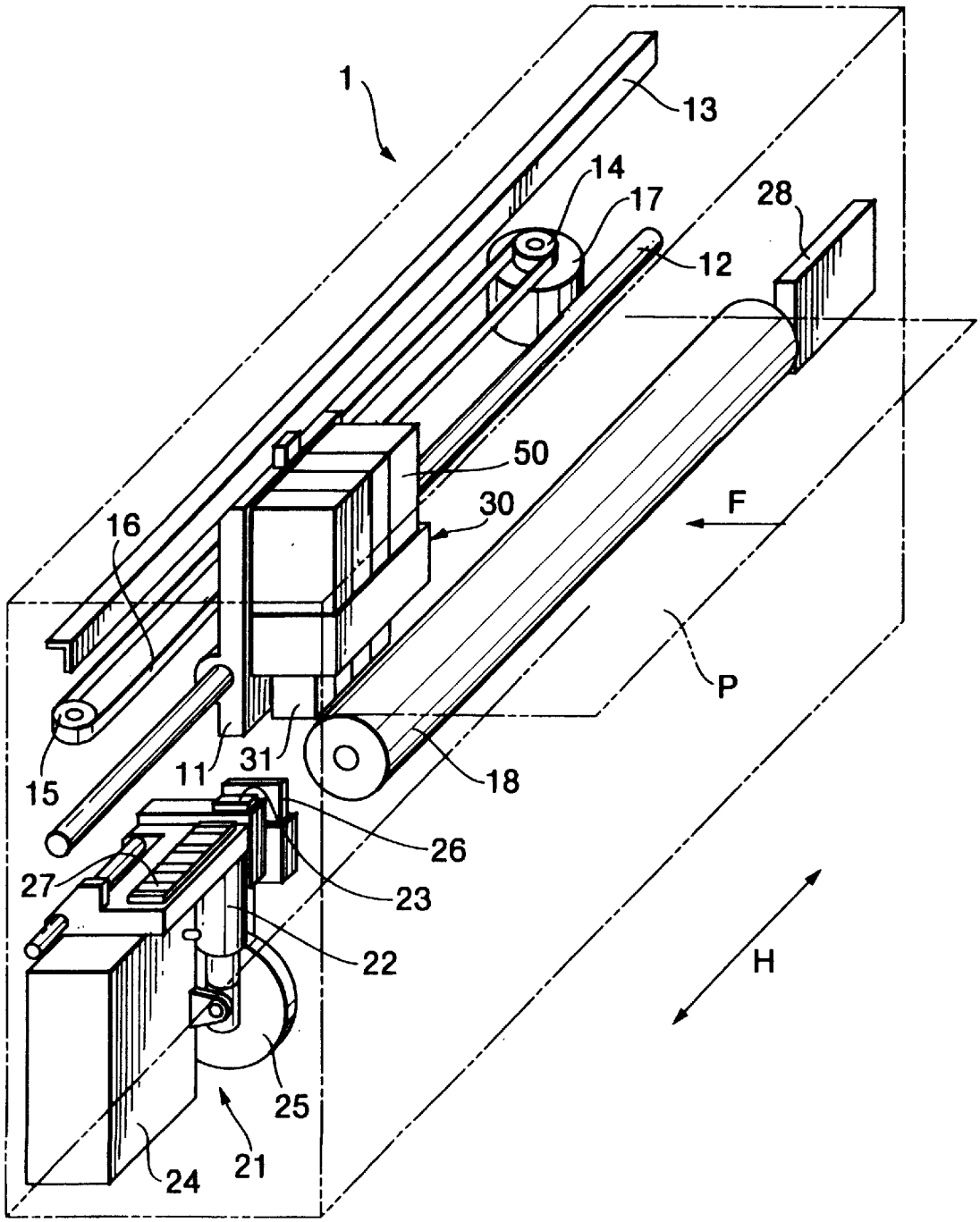
FIG. 1 is a perspective view of an ink jet recording device according to an embodiment of the present invention.
Figure 2:
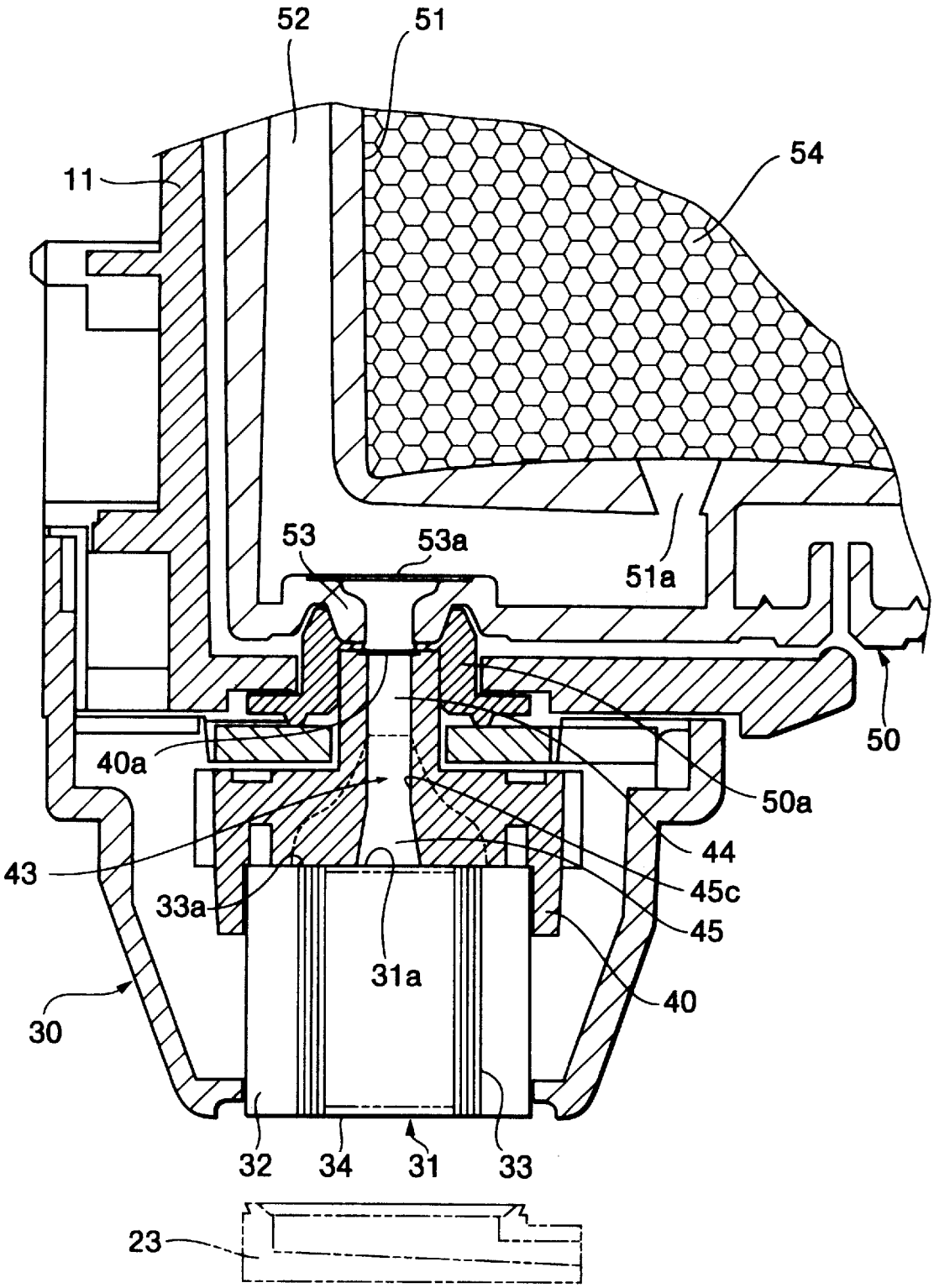
FIG. 2 is a partial cross-sectional view of the ink jet recording device of FIG. 1.

As shown in FIG. 1, the ink jet recording device 1 includes a carriage 11, a carriage shaft 12, a guide plate 13, a pair of pulleys 14, 15, a belt 16, a motor 17, a platen roller 18, a head unit 30, and four ink cartridges 50. Each of the ink cartridges 50 stores one of four different colored inks, that is cyan ink, magenta ink, yellow ink, and black ink. The head unit 30 includes four ink jet heads 31 and four manifolds 40 (FIG. 2). The manifolds 40 fluidly connect the ink cartridges 50 with corresponding ink jet heads 31 so that ink is supplied from the ink cartridge 50 to the corresponding ink jet heads 31. The head unit 30 and the ink cartridges 50 are both mounted on the carriage 11.

The carriage shaft 12 and the guide plate 13 are both supported by a frame (not shown) and extend in horizontal directions indicated by an arrow H. The carriage 11 is freely slidably supported on the carriage shaft 12 and the guide plate 13. The belt 16 is wound around and spans between the pair of pulleys 14, 15, and is connected to the carriage 11. When the motor 17 drives the pulley 14, the belt 16 reciprocally moves the carriage 11 along with the head unit 30 and ink cartridge 50 in the horizontal direction H.

The platen roller 18 is freely rotatable and extends in the horizontal direction H below the head unit 30 so as to be in facing confrontation with the lower surfaces of the ink jet heads 31. A print sheet P is fed by a feed mechanism (not shown) in a direction indicated by an arrow F. When the print sheet P is provided between the ink jet heads 31 and the platen roller 18, the ink jet heads 31 selectively eject ink onto the print sheet P to form an image on the print sheet P. The print sheet P formed with the image is, then, discharged out of the ink jet recording device 1.

Figure 3:
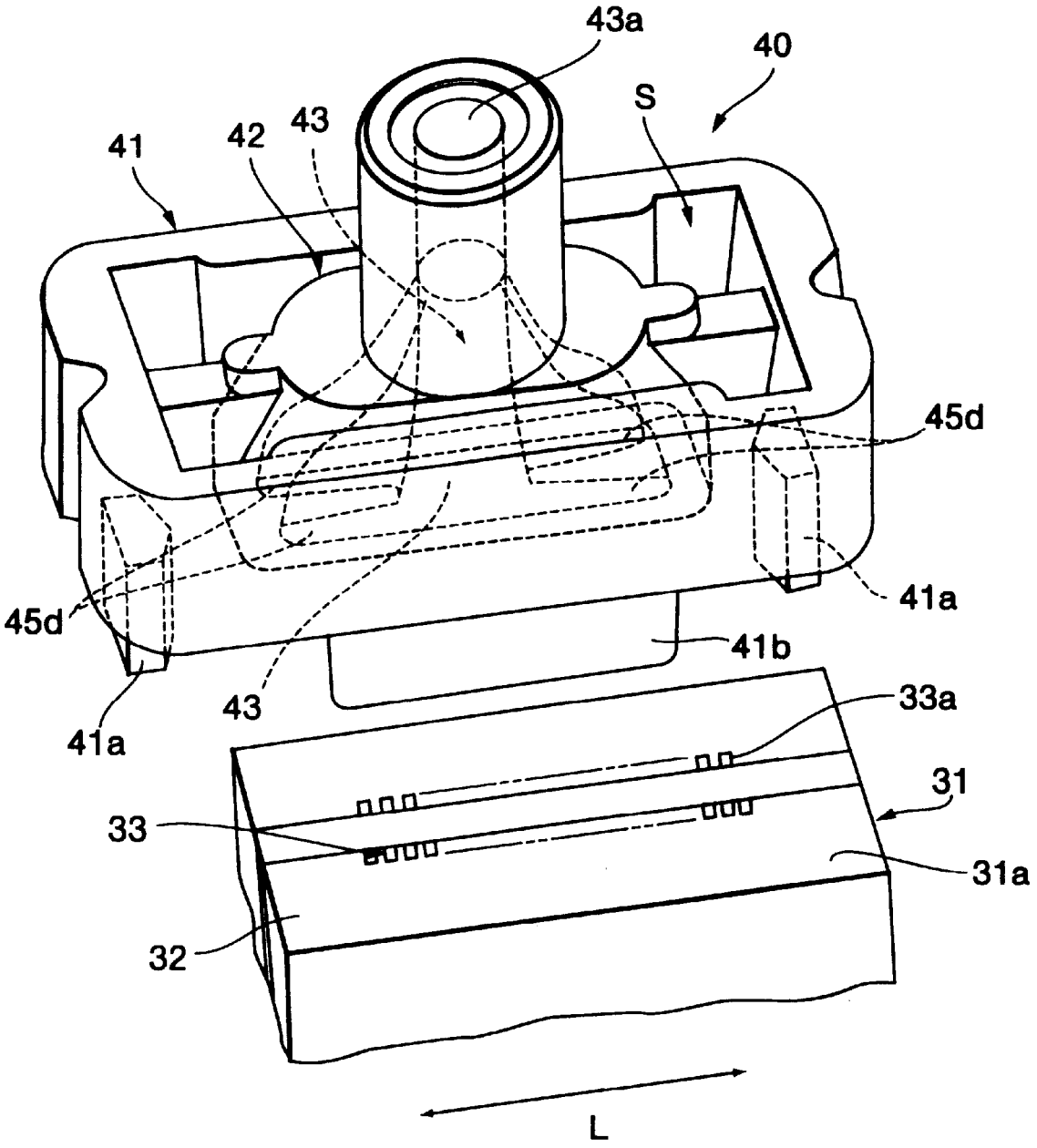
FIG. 3 is a perspective view showing a manifold and an ink jet head of the ink jet recording device of FIG. 1.

Next, detailed description of the ink jet heads 31 will be described. As shown in FIGS. 2 and 3, each ink jet head 31 includes an actuator 32 formed from a piezoelectric ceramic material and a nozzle plate 34 attached to the lower end of the actuator 32. The actuator 32 is formed with two rows of a plurality of ejection channels 33. The rows of ejection channels 33 extend longitudinally along the ink jet head 31 in directions indicated by an arrow L, and each ejection channel 33 extends from the lower end to the upper end of the actuator 32. The nozzle plate 34 is formed with a plurality of nozzles (not shown) in correspondence with the ejection channels 33.

Each ejection channel 33 has an ink inlet port 33*a* opened at an upper surface 31*a* of the ink jet head 31. Ink from the ink cartridge 50 is supplied into the ejection channels 33 through the ink inlet ports 33*a*.

When the actuator 32 is energized to deform during printing operations, the volume of the ejection channel 33 decreases, so that the ink is ejected from the ejection channel 33 through the nozzle, thereby forming an image on the print sheet P. Then, when the actuator 32 returns to its initial condition, the volume of the ejection channel 33 increases to its initial volume, thereby introducing ink from the ink cartridge 50 into the ejection channel 33. It should be noted that the ink jet head 31 can be designed such that ink is introduced into the ejection channel 33 when the actuator 32 deforms, and ink is ejected when the ejection channels 33 returns in its normal condition.

Next, the ink cartridge 50 will be described. As shown in FIG. 2, the ink cartridge 50 includes a joint member 50*a* by which the ink cartridge 50 is freely detachably attached to the upper end of the manifold 40. The ink cartridge 50 is formed with a first ink chamber 51, a second ink chamber 52, a connection hole 51*a*, and ink supply port 53. The first ink chamber 51 houses a porous ink absorption member 54 formed form polyurethane foam, for example. The ink absorption member 54 is impregnated with ink. The connection hole 51*a* fluidly connects the first ink chamber 51 with the second ink chamber 52. Ink impregnating the ink absorption member 54 in the first ink chamber 51 is supplied through the connection hole 51*a*, the second ink chamber 52, and the ink supply port 53 into the manifold 40. A mesh filter 53*a* is provided at the ink supply port 53.

Next, detailed description of the manifold 40 will be described. As shown in FIGS. 2 to 5, the manifold 40 includes a frame 41 and a main portion 42. The frame 41 has a pair of fixing ribs 41*a* and a pair of positioning ribs 41*b*. The pair of fixing ribs 41*a* are fixed to side surfaces of the ink jet head 31 by adhesive. The pair of positioning ribs 41*b* are for positioning the manifold 40 when fixed to the ink jet head 31. The main portion 40 is disposed interior of the frame 41 and partially connected to inner surfaces of the frame 41. A space S is defined between the frame 41 and the main portion 42. When the fixing rib 41*a* is fixed to the side surfaces of the ink jet head 31, adhesive is introduced to fill the space S, so that ink is prevented from leaking from the upper surface 31*a* of the ink jet head 31.

The lower end of the manifold 40 is fixed to the upper surface 31*a* of the ink jet head 31 so as to cover the upper surface 31*a*. The main portion 42 is formed with an ink supply path 43 fluidly connecting the ejection channels 33 with the ink cartridge 50.

As shown in FIG. 1, the ink jet recording device 1 further includes an ink suction unit 21, a wiper unit 26, a protection cap unit 27, and an ink support member 28. The ink suction unit 21, the wiper unit 26, and the protection cap unit 27 are disposed in a reset position of the ink jet heads 31, that is, at a position at the side of the platen roller 18. The ink suction unit 21 is for performing purging operations. The wiper unit 26 is for wiping the nozzle plates 34 of the ink jet heads 31. The protection cap unit 27 is for covering the nozzle plate 34 when printing is not being performed so that ink in the nozzles will not dry out. The ink support member 28 is disposed in a forced ejection position which is at the opposite end of the platen roller 18 from the reset position. The ink support member 28 is for absorbing and maintaining ink that was forcibly ejected from the ink jet heads 31. The forcible ink ejection is performed periodically for preventing the nozzles of the nozzle plate 34 from clogging. The ink suction unit 21, the wiper unit 26, the protection cap unit 27, and the ink support member 28 together configure a recovery maintenance mechanism for recovering and maintaining good ejection condition of the ink jet heads 31.

The ink suction unit 21 includes a suction pump 22, a suction portion 23, a waste ink tank 24, and a cam 25. The suction pump 22 and the suction portion 23 are driven by the drive force transmitted from a drive force transmission mechanism (not shown) and the cam 25. The ink suction unit 21 performs the purging operations regularly or when needed during the printing operations, and also right after the ink cartridge 50 is exchanged so as to introduce fresh ink from a new ink cartridge 50 into the ink supply path 43 and the ejection channels 33.

During the purging operations, the suction portion 23 covers the nozzle plate 34 of the ink jet head 31. In this condition, the suction pump 22 generates a negative purging pressure in the suction portion 23, so that defective ink with air bubbles is sucked out from the ejection channels 33 and the ink supply path 43. As a result, fresh ink is introduced from the ink cartridge 50 into the ink supply path 43 and the ejection channels 33. In this way, the ink jet head 31 becomes ready for printing. The defective ink sucked form the ink jet head 31 in this manner is conveyed to and held in the waste ink tank 24.

Next, detailed description of the ink supply path 43 of the manifold will be described. As shown in FIGS. 2 to 7, the ink supply path 43 includes a connection path 44 having a small diameter and a broad portion 45 connected with the connection path 44. The connection path 44 has an ink inlet 43*a* that is connected to the ink cartridge 50, and is substantially centered between the rows of ejection channels 33. A mesh filter 40*a* is provided at the ink inlet 43*a*.

Figure 5:
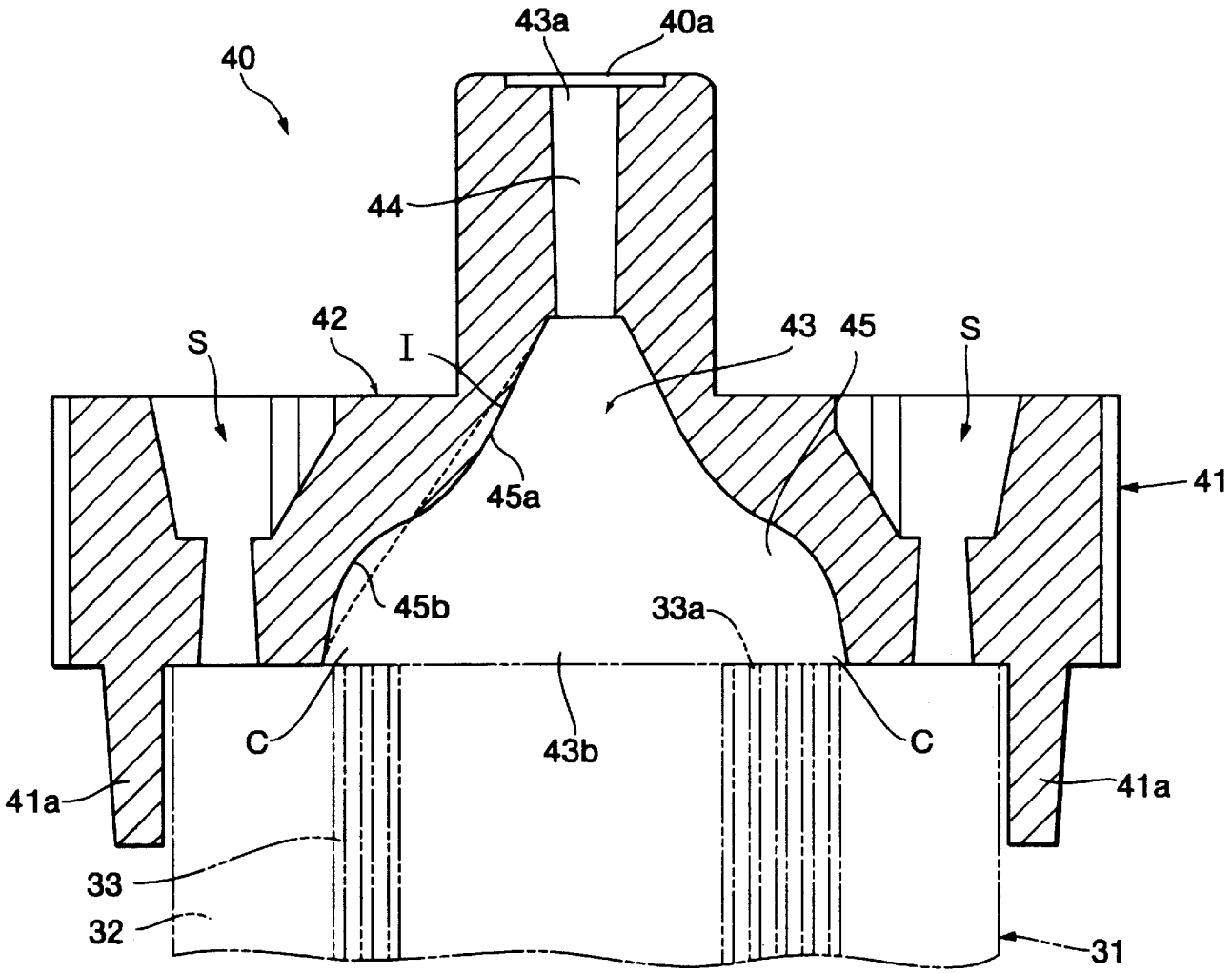
FIG. 5 is a cross-sectional view of the manifold taken along a line V—V of FIG. 4.

As shown in FIG. 5, the broad portion 45 broadens in a substantially symmetrical manner from the connection path 44 toward the ends of the rows of ejection channels 33 in an enlarging tapering manner, and has an ink outlet 43*b* encompassing the ink inlet ports 33*a* of the ejection channels 33. Specifically, the broad portion 45 is defined by an inner surface including a first curved surface 45*a* and a second curved surface 45*b*. The first curved surface 45*a* broadens in a tapering manner from the connection path 44, and protrudes inward toward the interior of the broad portion 45. The second curved surface 45*b* extends in connection with the first curved surface 45*a* toward the end of the row of ejection channels 33, and protrudes away from the interior of the broad portion 45. That is to say, with respect to an imaginary straight line I that connects the connection path 44 with the end of the row of ejection channels 33, the first curved surface 45*a* protrudes interior of the imaginary straight line I, and on the other hand, the second curved surface 45*b* protrudes outward from the imaginary straight line I. The second curved surface 45*b* is a wide incline with respect to the upper surface 31*a* of the ink jet head 31, and defines the corner portion C. In other words, the second curved surface 45*b* extends substantially vertically at a portion adjacent to the upper surface 31*a*

Figure 4:
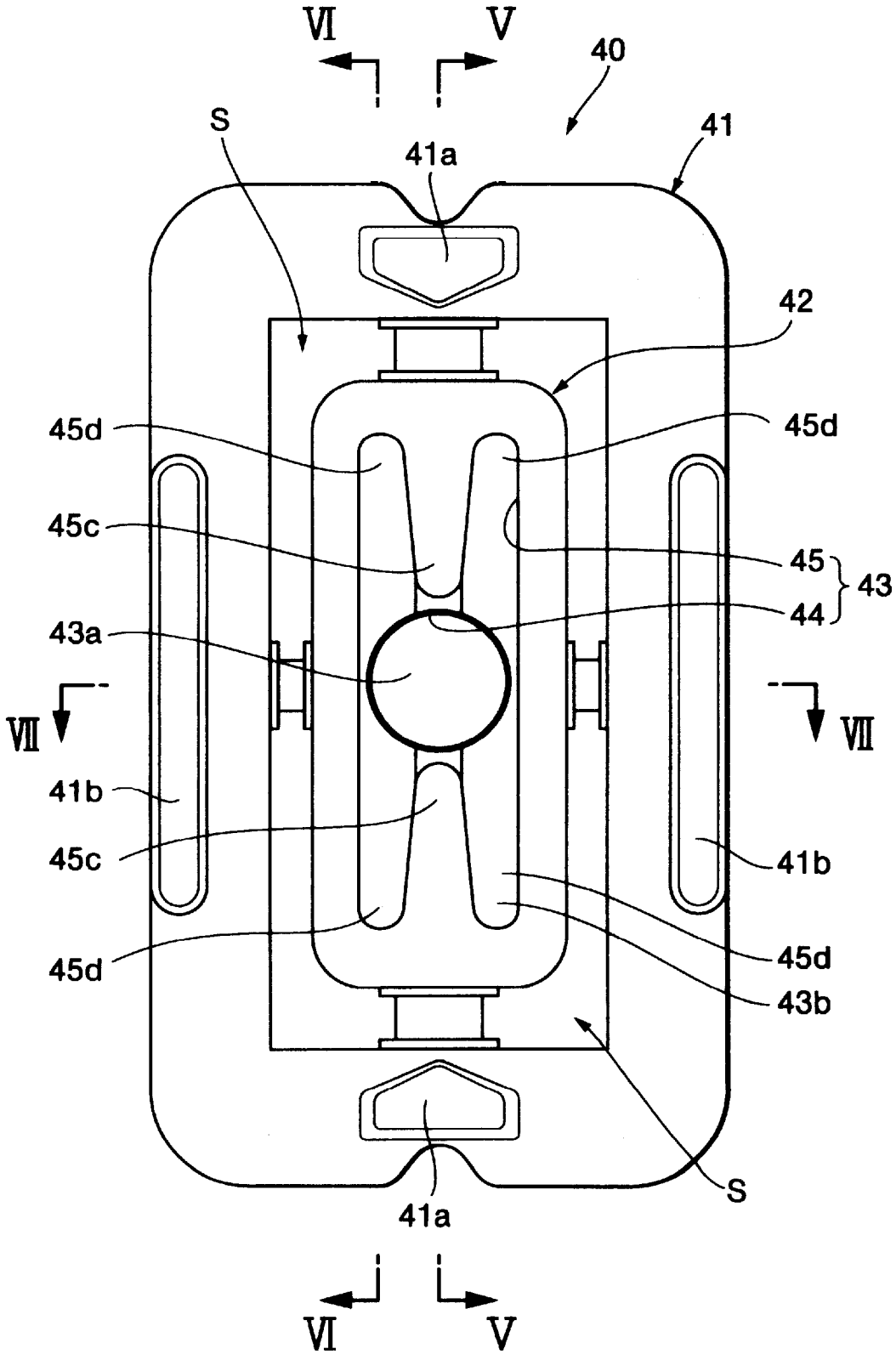
FIG. 4 is a plan view of the manifold.
Figure 6:
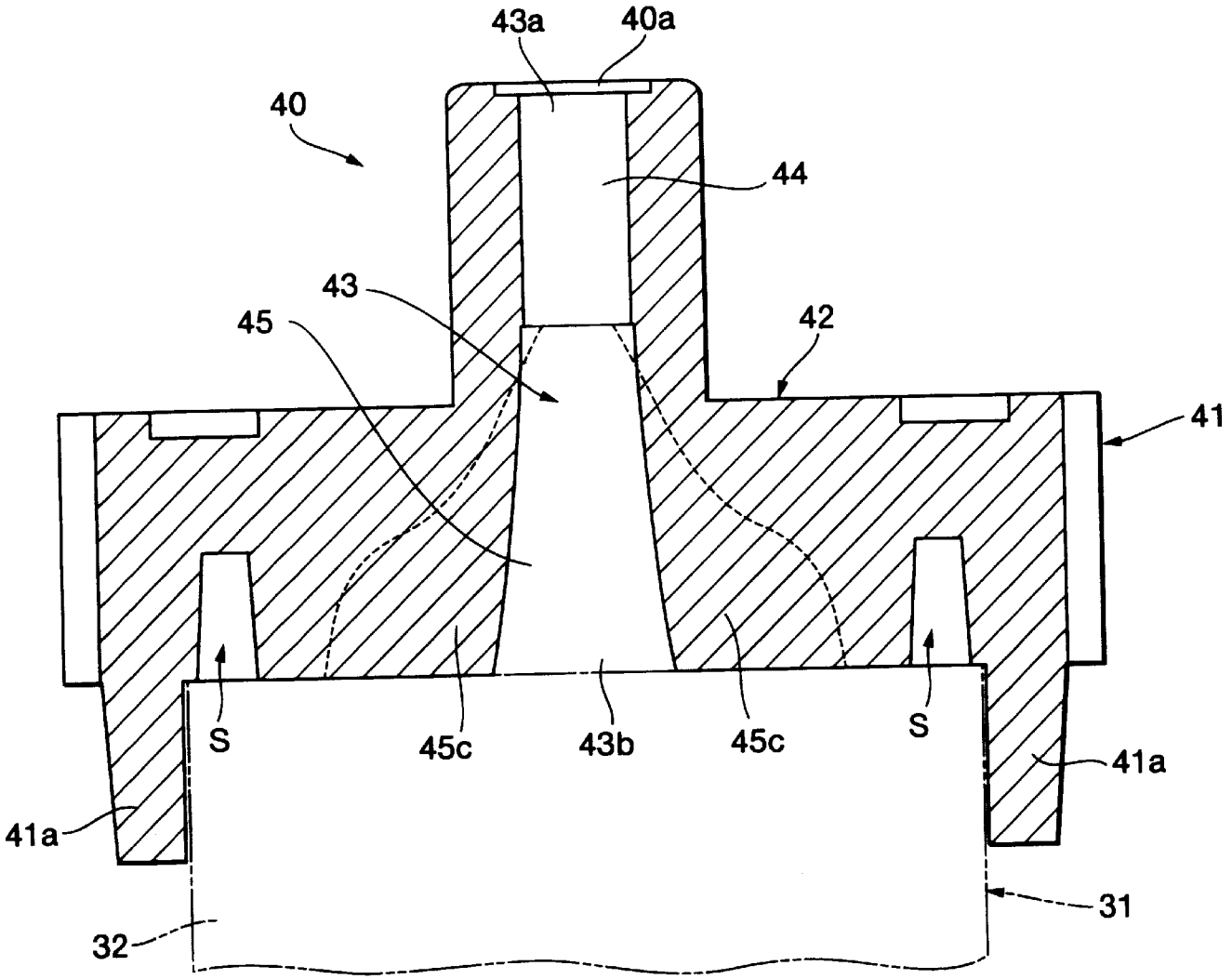
FIG. 6 is a cross-sectional view of the manifold taken along a line VI—VI of FIG. 4.
Figure 7:
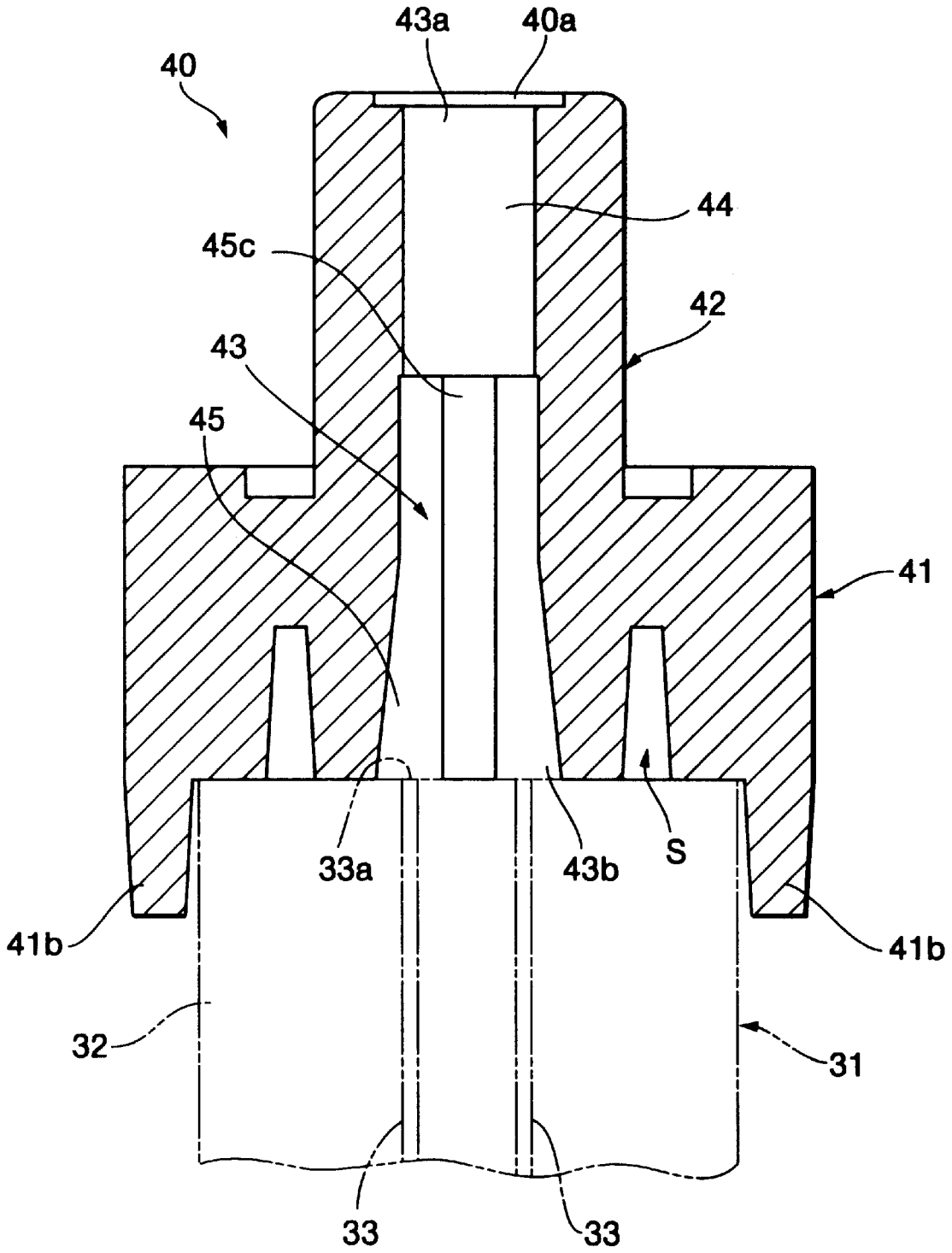
FIG. 7 is a cross-sectional view of the manifold taken along a line VII—VII of FIG. 4.

As shown in FIGS. 4 and 6, the main portion 42 has integral guide walls 45*c* that protrude toward the interior of the broad portion 45 between the rows of ejection channels 33. The guide walls 45*c* are connected to ceiling surfaces of the broad portion 45, and extend to near the connection path 44. It should be noted that a portion of the first curved surface 45*a* serves as the ceiling surface of the broad portion 45. The guide walls 45*c* define separate ink channels 45*d* within the broad portion 45. The ink channels 45*d* fluidly connect the corresponding rows of ejection channels 33. The width of the narrow ink channel 45*d*, that is, the distance between the outer surfaces of the guide walls 45*c* and the inner side surfaces of the broad portion 45, is set to induce capillary action for drawing liquid ink through the narrow ink channel 45*d*.

Next, the purging operations performed after exchange of the ink cartridge 50 will be described. The purging operations are performed for introducing fresh ink from a new ink cartridge 50 into the ink supply path 43 and the ejection channels 33 and also for discharging air bubbles out of the ink supply path 43 and the ejection channels 33.

With this configuration, when the ink suction unit 21 generates negative purging pressure in the ejection channels 33 during purging operations, fresh ink is introduced from the ink cartridge 50 into the ink supply path 43. Because the presence of the guide walls 45*c* decreases the volume of the broad portion 45, the speed of ink flow increases overall. Therefore, air bubbles clinging to the inner surfaces of the broad portion 45 are easily peeled off and discharged out of the ink jet head 31 through the ejection channels 33.

Figure 8:
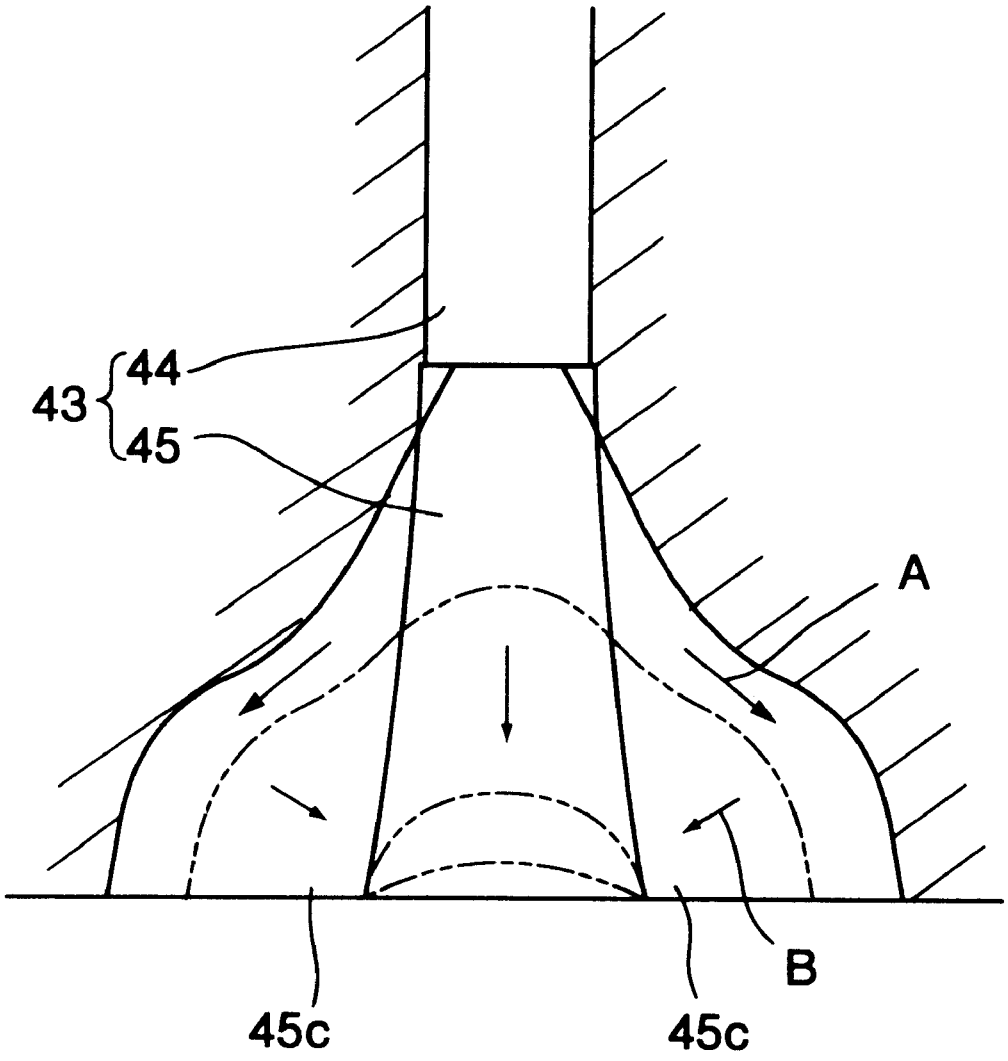
FIG. 8 is a cross-sectional view indicating stages in how ink fills an ink supply path of the manifold during purging operations.

Also, during purging operations performed immediately after exchange of the cartridge 50, capillary action and purging pressure draw ink into the ink supply path 43 towards the corner portions C as indicated by an arrow A in FIG. 8, and further toward the center of the rows of ejection channels 33 as indicated by an arrow B in FIG. 8. It should be noted that two-dot chain lines in FIG. 8 indicate the stages in how ink fills the broad portion 45. Therefore, air bubbles hardly stay at the corner portions C, and are reliably discharged out of the ink jet head 31 through the ejection channels 33.

Because the second curved surface 45*b* is connected to the upper surface 31*a* of the ink jet head 31 by the wide incline, ink flows into the corner portions C almost straight downward, so that the amount of residual bubbles remaining at the corner portion C can be greatly reduced. Also, even if an air bubble remains in the corner portions C, the air bubble will easily float toward the connection path 44 by its buoyancy. Therefore, the air bubbles will not be easily drawn into the ejection channels 33 during printing operations. Also, even if the air bubble clings to the second curved surface 45*b* and grows to a large size, because the depth h is secured above the corner portion C, the grown air bubble takes a certain amount of time before reaching the ink inlet ports 33*a*. Accordingly, there is no need to frequently perform purging operations during the printing operations.

Further, as described above, the upper surface 31*a* faces upward and spreads horizontally, and the manifold 40 is mounted on the ink jet head 31 from above. With this configuration, even if air bubbles remain in the ink supply path 43 without being discharged by purging operations, the air bubbles will not cluster in one place, so that the air bubbles can be easily discharged by subsequent purging operations.

Also, because the manifold 40 has an integral shape with open ends, the manifold 40 can be produced into the predetermined shape with a precise size by molding techniques.

The presence of the guide walls 45*c* greatly decreases the volume of the ink supply path 43. However, because a fairly large volume is secured within the connection path 44, which is separated from the ink jet head 31, influence of cross-talk will not be easily received.

Because the connection path 44 is substantially centered between the rows of ejection channels 33 as described above, the second curved surface 45*b* is a wider incline with respect to the upper surface 31*a* of the ink jet head 31 than in the case where the connection path is positioned at one side of the rows of ejection channels. As a result, air bubbles will easily float toward the connection path 44, so that the air bubbles will not be easily drawn into the ejection channels 33 during printing operations.

While the invention has been described in detail with reference to specific embodiments thereof, it would be apparent to those skilled in the art that various changes and modifications may be made therein without departing from the spirit of the invention, the scope of which is defined by the attached claims.

For example, although in the above-described embodiment, ink jet head 31 is formed with two rows of ejection channels 33, the ink jet head 1 can be formed with three or more rows of ejection channels. In this case, additional guide walls 45*c* should be provided.

Also, in the above-described embodiment, purging operations are performed by the ink suction unit 21 by sucking ink from the ejection channels 33 of the ink jet head 31. However, purging operations can be performed by pushing fresh ink from the ink cartridge 50 into the ink jet head 31.

What is claimed is:

1. An ink jet recording device comprising:

an ink jet head having a first surface and a second surface opposite from the first surface, the ink jet head being formed with at least two channel rows aligned in parallel with each other, each of the at least two channel rows including a plurality of channels, each of the plurality of channels extending from the first surface to the second surface and having an ink inlet port opened at the first surface and an election nozzle opened at the second surface; and a manifold that is formed with an ink supply path fluidly connecting the plurality of ink channels and a cartridge that stores ink, the ink supply path including a connection portion and a broad portion, the connection portion being centered between the at least two channel rows and fluidly connected to the cartridge, the broad portion broadening from a connection portion side to a first surface side of the ink jet head so as to encompass the ink inlet ports of the plurality of channels, the manifold including guide walls positioned between the at least two channel rows, wherein the ink inlet port of each of the plurality of channels faces the connection port side without obstruction.

2. The ink jet recording device according to claim 1, wherein the first surface of the ink jet head faces upward in use, and the broad portion of the ink supply path encompasses the ink inlet ports of the plurality of channels from above.

3. The ink jet recording device according to claim 1, wherein the broad portion of the ink supply path is defined by a ceiling surface, the guide walls are connected to the ceiling surface near the connection portion, the guide walls defining ink paths within the broad portion, the ink paths having a width which induces capillary action to draw ink through the ink paths.

4. The ink jet recording device according to claim 1, further comprising a suction unit that is detachably mounted on the second surface of the ink jet head, the suction unit generating negative pressure in the ink supply path for introducing the ink from the cartridge to the plurality of channels through the ink supply path.

5. The ink jet recording device according to claim 4, wherein the at least two channel rows have ends, the broad portion of the ink supply path is defined by a ceiling surface, the guide walls extend from the connection portion to the ends of the at least two channel rows and between the ceiling surface of the ink supply path and the first surface of the ink jet head, and the guide walls provide ink paths within the broad portion.

6. The ink jet recording device according to claim 5, wherein the ink introduced into the ink supply path from the cartridge by the negative pressure generated by the suction unit is drawn toward the ends of the at least two channel rows through the ink paths by the capillary action and the negative pressure.

7. The ink jet recording device according to claim 1, wherein the guide walls decrease a volume of the ink supply path so as to increase a flow speed of the ink within the ink supply path.

8. The ink jet recording device according to claim 1, wherein the manifold has a first end and a second end opposite from the first end, the connection portion has an opening at the first end, the broad portion has an opening at the second end, the broad portion is defined by a ceiling surface facing the first surface of the ink jet head, the guide walls extend from the ceiling surface toward the opening of the broad portion.

9. The ink jet recording device according to claim 1, wherein the broad portion is defined by an inner surface that extends substantially vertically at least at a portion adjacent to the first surface.

10. The ink jet recording device according to claim 1, wherein the broad portion is defined by a first curved surface and a second curved surface, the first curved surface broadening in a tapering manner from the connection portion and being inwardly convex, the second curved surface extending from the first curved surface toward ends of the at least two channel rows and being outwardly convex.

11. The ink jet recording device according to claim 1, wherein the ink jet head comprises a plurality of piezoelectric elements that are deformable and define the plurality of channels, and ink droplets are ejected when the piezoelectric elements deform.

12. The ink jet recording device according to claim 1, wherein the manifold comprises a fixing rib separate from the guide walls, the fixing rib being attached to the ink jet head by an adhesive, the manifold and the ink jet head being attached to each other by the fixing rib.

13. An ink jet recording device comprising:

an ink jet head having a first surface and a second surface opposite from the first surface, the ink jet head being formed with a plurality of channels extending from the first surface to the second surface and having an ink inlet port on the first surface and an ejection nozzle on the second surface; and a manifold that is formed with an ink supply path fluidly connecting the plurality of channels with a cartridge that stores ink, the ink supply path including a first portion and a second portion, the first portion being fluidly connected to the cartridge, the second portion being fluidly connected to and formed between the first portion and the plurality of channels, the second portion having a width that induces capillary action to draw the ink through the second portion, wherein the inlet port of each of the plurality of channels faces the connection port side without obstruction.

14. An ink jet recording device comprising:

an ink jet head having a first surface and a second surface opposite from the first surface, the ink jet head being formed with at least two channel rows aligned in parallel with each other, each of the at least two channel rows including a plurality of channels, each of the plurality of channels extending from the first surface to the second surface and having an ink inlet port opened at the first surface and an ejection nozzle opened at the second surface; and a manifold that is formed with an ink supply path fluidly connecting the plurality of ink channels and a cartridge that stores ink, the ink supply path including a connection portion and a broad portion, the connection portion being centered between the at least two channel rows and fluidly connected to the cartridge, the broad portion broadening from a connection portion side to a first surface side of the ink jet head so as to encompass the ink inlet ports of the plurality of channels, the manifold including guide walls positioned between the at least two channel rows, wherein the manifold comprises a fixing rib separate from the guide walls, the fixing rib being attached to the ink jet head by an adhesive, the manifold and the ink jet head being attached to each other by the fixing rib.

* * * * *